US006098223A

United States Patent [19]

Larson

[11] Patent Number: 6,098,223

[45] Date of Patent: Aug. 8, 2000

[54] INNER SPRING MATTRESS WITH FIRMNESS ADJUSTING AIR BLADDERS

[76] Inventor: Lynn D. Larson, 5410 NW. 44th St., Lincoln, Nebr. 68524

[21] Appl. No.: 09/074,510

[22] Filed: May 7, 1998

[51] Int. Cl.[7] ..... A47C 27/08

[52] U.S. Cl. ..... 5/716; 5/654; 5/713

[58] Field of Search ..... 5/713, 706, 714, 5/716, 655.3, 654

[56] References Cited

U.S. PATENT DOCUMENTS

| | | | |
|---|---|---|---|
| 2,779,034 | 1/1957 | Arpin | 5/709 X |
| 2,814,053 | 11/1957 | Sevcik | 5/710 |
| 3,879,776 | 4/1975 | Solen | 5/655 |
| 3,919,730 | 11/1975 | Regan | 5/710 X |
| 4,120,061 | 10/1978 | Clark | 5/710 |
| 4,357,724 | 11/1982 | Laforest | 5/706 |
| 4,827,546 | 5/1989 | Cvetkovic | 5/706 |
| 5,113,539 | 5/1992 | Strell | 5/710 |

*Primary Examiner*—Terry Lee Melius
*Assistant Examiner*—Fredrick Conley
*Attorney, Agent, or Firm*—Zarley, McKee, Thomte, Voorhees & Sease; Dennis L. Thomte

[57] ABSTRACT

An inner spring mattress with firmness adjusting air bladders, the inflation pressure of which defines the mattress firmness. A plurality of inflatable bladders are disposed within the mattress. The bladders may span the entire width of the mattress. Alternatively, the width of the mattress may be divided in two using two bladders placed end-to-end providing independent firmness control for both sides of the mattress. Still further, bladders may be grouped together to form firmness zones, and the entire process may be computer controlled.

9 Claims, 4 Drawing Sheets

INNER SPRING MATTRESS WITH FIRMNESS ADJUSTING AIR BLADDERS

TECHNICAL FIELD

The apparatus of the present invention relates generally to sleeping mattresses. More specifically, it relates to a mattress having a plurality of vertically oriented, horizontally spaced internal springs providing support in the normal fashion. Additionally, the mattress comprises a means for adjusting the firmness of the mattress on an as needed basis. In one preferred embodiment, this firmness adjustment is provided by a plurality of internally positioned, inflatable air bladders, the firmness or resiliency of which is directly proportional to the pressure to which the bladder is inflated.

Conventional mattresses rely almost completely on internal springs to provide the necessary support and firmness characteristic of the mattress. Thus, the firmness of an individual mattress is determined by the nature of the springs used in its manufacture. Consequently, there is no means for adjusting the firmness of the mattress once it is manufactured.

The present invention describes an mattress wherein the firmness thereof may be adjusted on an as needed basis. For example, the firmness may be adjusted for individual comfort. This adjustment may continue throughout the life of the mattress to compensate for changes in individual needs or for the natural "aging" of the mattress springs.

A nearly limitless number of bladder configurations for firmness adjustment exist. For example, the firmness adjustment bladders may be "zoned" for different parts of the body which require different firmness. Additionally, the mattress may be divided lengthwise into two sections with separate bladders corresponding to each section, thereby permitting individual firmness control on each side of the mattress. The bladders may be separately connected to air pumps for inflation. Furthermore, the pumps or the control mechanism therefore, may include a computer control. Indeed, the invention even accommodates the use of computer control to adjust the firmness of the mattress as the sleeping individual rolls during the night. Thus, it can be seen that the invention provides an apparatus which is capable of a great variety of individual firmness adjustment.

BACKGROUND OF THE INVENTION

Air mattresses have been around for sometime. However, generally, these mattresses are intended for recreation, such as flotation in the water, or as temporary bedding such as on camp outs, or visits away from home.

Similarly, conventional spring mattresses have been around for a long time. These mattresses generally have a plurality of vertically oriented, horizontally spaced springs within the enclosed mattress chamber. These conventional mattresses rely on these internal springs to provide the necessary support and firmness of the mattress. The firmness of an individual mattress is determined by the nature of the springs used in its manufacture. Thus, while the firmness of a mattress may be varied at the time of its manufacture by an appropriate selection of springs, the firmness is set, once the manufacture is complete. There is no means for adjusting the firmness of the mattress once it leaves the plant. Additionally, while the manufacturer may provide mattresses of varying firmness in his product line, the number of such selections is obviously limited. Due to production considerations, the manufacture is not able to routinely offer mattresses of individually tailored firmnesses. Furthermore, to the extent that a mattress of individually tailored firmnesses may be special ordered, such one-of-a-kind mattress is necessarily quite expensive. Then again, once the mattress is manufactured, its firmness is fixed and can not be further adjusted.

Thus, there is a great need for a mattress which is able to support an individual at rest and which also provides a means for adjusting the firmness of the mattress to suit individual requirements and tastes.

SUMMARY OF THE INVENTION

Consequently, it is a primary objective of the present invention to provide an inner spring mattress with firmness adjusting air bladders adapted to permit the firmness adjustment of the mattress on an as needed basis, by varying the inflation pressure of the bladder.

Another objective is to provide an inner spring mattress with firmness adjusting air bladders wherein bladders having a length one-half the width of he mattress, are placed end-to-end to span the width of the mattress thereby allowing the mattress to be separated into two "firmness zones" corresponding to opposite sides of the bed and thereby allowing separate firmness selection to be made by each individual.

An additional objective is to provide an inner spring mattress with firmness adjusting air bladders wherein the individual bladders may be individually inflated to provide precise firmness adjustment.

An additional objective is to provide an inner spring mattress with firmness adjusting air bladders wherein the inflation pressure of individual bladders may be controlled by computer.

An additional objective is to provide an inner spring mattress with firmness adjusting air bladders wherein the pump(s) for inflating the bladders may be positioned internally or externally of the mattress.

An additional objective is to provide an inner spring mattress with firmness adjusting air bladders wherein each bladder may be supplied by a separate, individually controllable pump.

An additional objective is to provide an inner spring mattress with firmness adjusting air bladders wherein a separate bladder may be used with each mattress spring.

An additional objective is to provide an inner spring mattress with firmness adjusting air bladders wherein the mattress may be subdivided into zones corresponding to different portions of the body by tying the inflation of several bladders together.

An additional objective is to provide an inner spring mattress with firmness adjusting air bladders wherein the mattress firmness may be adjusted to compensate for the natural "aging" of the mattress springs.

A final objective is to provide an inner spring mattress with firmness adjusting air bladders wherein a computer control of the bladders may be utilized to adjust the firmness of the mattress as the sleeping individual rolls during the night.

The present invention discloses an inner spring mattress with firmness adjusting air bladders adapted to be supported on a frame, the bladders being connectable to an inflation device for inflation thereof. The mattress comprises a spring mattress having top and bottom walls and a side wall connecting the periphery thereof, the top, bottom and side walls defining an enclosed chamber. A plurality of vertically oriented springs, are arranged in horizontally spaced relation within the chamber. A plurality of inflatable bladders are also disposed within the chamber and adapted for inflation in response to the introduction of a fluid (such as air) therein. The firmness of the bladders, and thus the mattress, is proportional to the inflation pressure of the bladders. Thus, the plurality of bladders are connected to the inflation device, such that upon inflation, the bladders assume a firmness proportional to the pressure of fluid contained therein, thereby maintaining the mattress top and bottom in spaced apart relation, resisting downward pressure thereon in proportion to the fluid pressure therein.

The inner spring mattress with firmness adjusting air bladders of the present invention may comprise bladders spanning the entire width of the mattress. Alternatively, the width of the mattress may be divided in two using two bladders placed end-to-end providing independent firmness control for both sides of the mattress. The invention teaches several embodiments providing varying degrees of firmness adjustability. For example, each of the bladders may have a baffle positioned within the bladder such that the bladder is subdivided widthwise defining two firmness zones, each of the firmness zones being independently inflatable by the inflation device. Alternatively, each of the bladders may be independently connected to the inflation device (e.g. pump), such that each of the bladders may be individually inflated.

Other embodiments taught include a computer to monitor and control the inflation, and embodiment wherein the plurality of bladders comprises a bladder disposed within each of the springs, an embodiment wherein a number of the plurality of bladders is simultaneously connected to the inflation device, the number of bladders defining a zone, each of the zones being inflatable independent of each other; an embodiment wherein a computer control of the bladders may be utilized to adjust the firmness of the mattress as the sleeping individual rolls during the night and finally wherein the control means further comprises a transducer operative to monitor the pressure within a bladder and to regulate the inflation of the bladder in response thereto.

The present invention also discloses a method of adjusting the firmness of a mattress comprising the steps of providing an inflation device such as a pump. Providing a spring mattress having, a plurality of inflatable bladders disposed within the chamber and adapted for inflation in response to the introduction of a fluid therein, the bladder having a firmness proportional to the pressure of fluid contained therein. A means for connecting the plurality of bladders to an inflation source, so that the bladders may be inflated to contact and support the mattress top and bottom. The bladders would be connected to the inflation device and inflated to a pressure corresponding to the desired firmness. Since the bladders may have a baffle positioned within the bladder to divide the mattress widthwise into two firmness zones, the method may further comprise separately inflating the bladder portions such that the each bladder portion is inflated to the desired firmness. The method may also comprise connecting a plurality of bladder together in a zone, each of the zones being inflatable independently of each other, and separately inflating each of the zones such that the zones are inflated to the desired pressure.

DESCRIPTION OF THE PREFERRED EMBODIMENT

The present invention describes a mattress wherein the firmness may be adjusted on an as needed basis for individual comfort. This adjustment may continue throughout the life of the mattress to compensate for the natural "aging" of the mattress springs. Firmness adjustment is provided by a series of bladders within the mattress, the firmness of which is controlled by the degree to which they are inflated.

Figure 1:
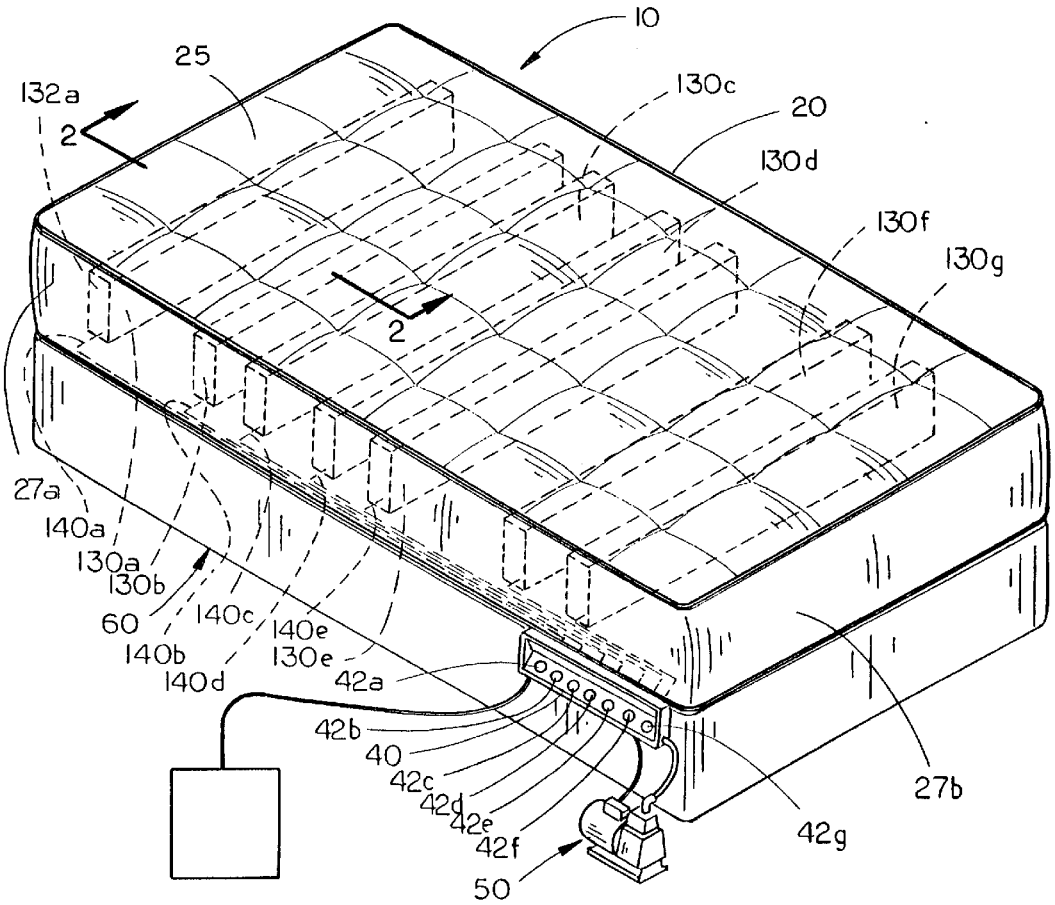
FIG. 1 is a perspective view showing in hidden lines a plurality of internal air bladders positioned within a mattress used to adjust the firmness thereof.

FIG. 1 is a perspective view of a preferred embodiment of the present invention 10 shown installed in a spring mattress 20. The mattress 20 would have top and bottom walls 25 and 26 respectively, and connecting side walls 27*a–d*, defining an enclosed chamber 28. A plurality of vertically oriented springs 22 (FIG. 2) are horizontally spaced throughout the enclosed mattress chamber 28 to provide support for the person lying thereon. Also used in constructing mattress 20 are ¼ to ½ inch thick foam pads 29*a* & *b* (FIG. 2) positioned adjacent the interior of the top and bottom mattress walls for providing additional cushioning.

The mattress 20 is adapted to be supported on a frame 60 in the conventional manner. The frame could range from a simple platform supported by four legs, to a conventional box springs. Of course it is also possible for the mattress of the present invention to be used simply on the floor.

As seen in FIG. 1 and the following figures, a plurality of bladders running transversely thorough the mattress at various points along its length is used to effect the firmness adjustability of the present invention. As mentioned, a primary objective of the present invention is to achieve individual control of mattress firmness. The present invention teaches the use of inflatable bladders, the firmness of which is proportional to the pressure to which the bladder is inflated, to achieve this control. There are several possible configurations for these bladders depending of the degree of adjustability desired.

Figure 5:
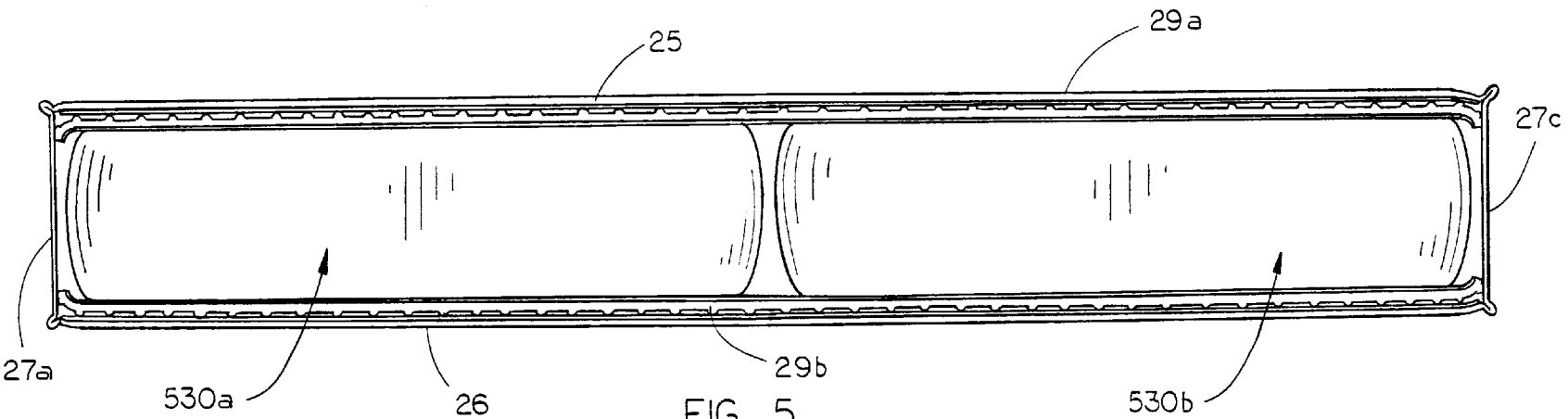
FIG. 5 illustrates how two bladders may be utilized in a side-by-side configuration to provide different degrees of firmness between both sides of the mattress.

In FIG. 1, one embodiment is illustrated wherein these bladders 130*a*–130*g* comprise single chamber bladders. In other alternative embodiments described below, a bladder may be divided into two separate chambers 630*a* and 630*b* (FIG. 6) to allow each chamber, corresponding to opposite sides of the bed, to be pressurized to a different firmness if desired. Another alternative embodiment is to utilize two separate bladders 530*a* and 530*b* placed side-by-side to span the mattress width (FIG. 5). These embodiments are described below in connection with the appropriate figure.

As seen in FIG. 1, a plurality of bladders 130*a–g* are positioned transversely within the mattress and throughout its length. As mentioned, the degree of inflation of these bladders 130*a–g* is used to permit the firmness adjustment. These bladders are inflatable with air or some other fluid.

Furthermore, the bladders are of a size such that they span the enclosure chamber 28 distance between the top and bottom walls 25 and 26 of mattress shell 20. Thus, by adjusting the inflation pressure, the mattress firmness may be adjusted. Clearly, since a single bladder chamber spans the mattress width, the firmness (i.e. inflation pressure) will be constant in a widthwise dimension. to However, the inflation pressure may be varied between bladders permitting the firmness to vary along the length of the mattress.

In a preferred embodiment, the inflation of the bladders would be accomplished using a conventional pump 50. The pump may be connected directly to the bladders, or a control means 40 may be utilized to control the flow of fluid (pressure) into the bladder and its resulting firmness. In one embodiment, control 40 may be a simple on/off switch or valve. In other situations where more precise control is desired, control 40 may comprise a system which permits the pressure in the bladders to be more precisely regulated. For example, in the embodiment illustrated in FIG. 1, each bladder 130*a–g* is individually connected to the pump 50 through the control means 40 by an associated air line 140*a–g* respectively. A pressure transducers 32*a–g* may be used to sense the pressure in each of the bladders 130*a–g* respectively. In much the same way a thermostat operates, the desired pressure may be preset using control knobs 42*a–g* associated with bladders 130*a–g* respectively. The transducers 32*a–g* would then monitor the pressure in the corresponding bladder and compare it to the preset value. If the pressure in the bladder is less than that desired, the control means 40 would maintain the flow control valve (not shown) in the open position, allowing more air to flow into the bladder from pump 50. Once the desired pressure is reached, the flow valve would be closed and the pressure transducer would continue to monitor the bladder pressure. If the pressure in the bladder were to drop below the preset value, the flow control valve could be temporarily opened until the desired pressure is again reached.

It will be clear to those in the art that a computer 45 may be utilized in conjunction with transducers 32*a–g* and as part of control 40, to monitor the bladder pressures and control the inflation thereof. In this embodiment, any type of firmness gradient may be entered into the computer 45. The computer 45, in conjunction with the transducers, could then monitor the bladder pressures, to achieve and maintain the desired firmness profile. The invention also suggests that such monitoring and controlling can continue throughout the night, compensating the inflation pressure as the person turns in his or her sleep.

Figure 2:
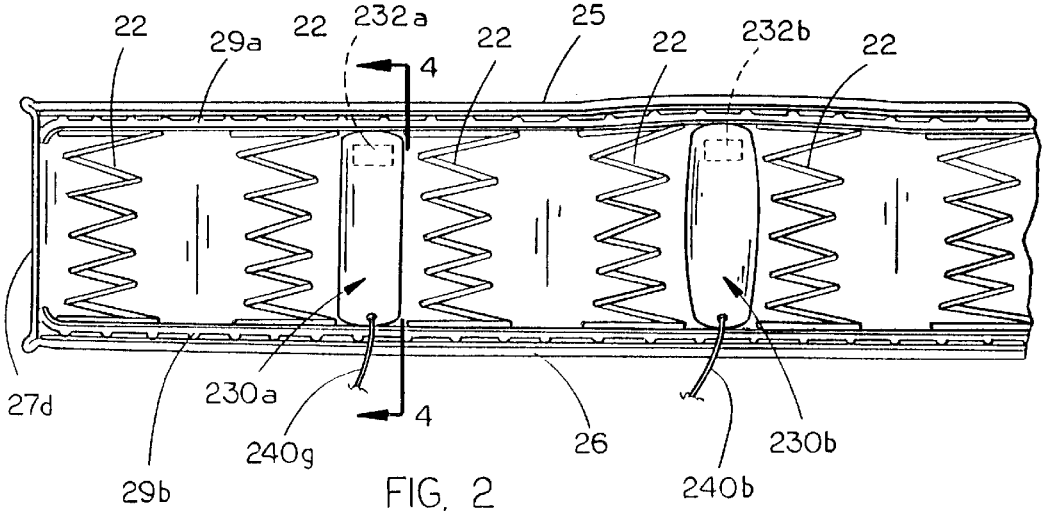
FIG. 2 is a side sectional view of the invention showing two air bladders in different stages of inflation.
Figure 4:
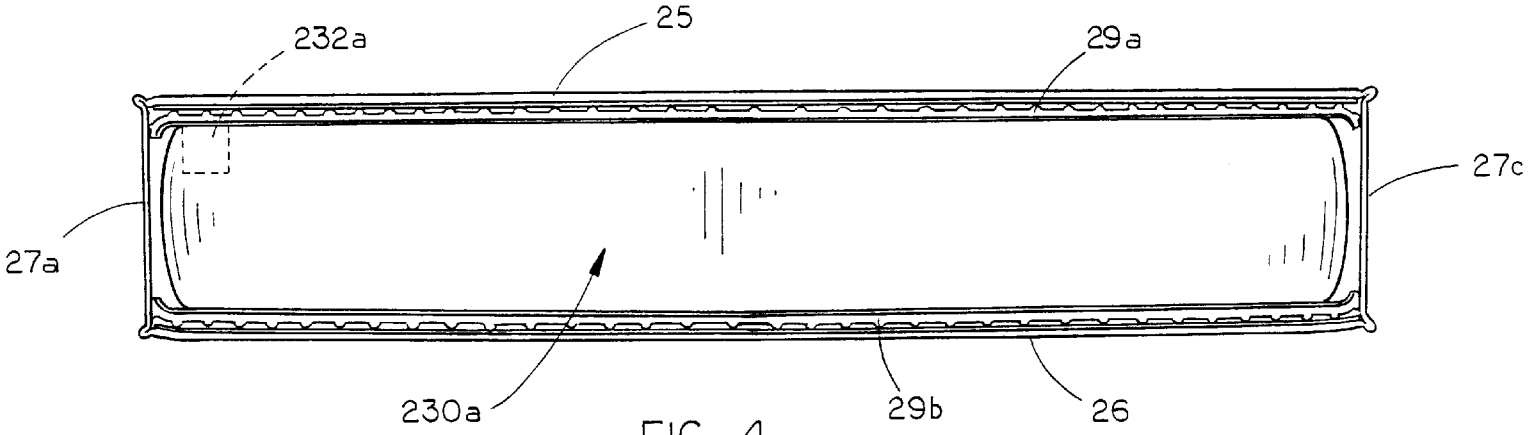
FIG. 4 is a view taken along the lines shown in FIG. 2 showing how an air bladder is used to fill the width and height of the mattress.

FIGS. 2 and 4 are side and front sectional views respectively of the mattress of the present invention showing the size and positioning of the bladders therein. As seen more particularly in FIGS. 2 and 4, the bladders are in one embodiment, adapted to run widthwise through the mattress adjacent the springs 22. Also seen clearly in these views is the size of the bladders. The bladders e.g. 230*a*, are adapted to be of a height to completely fill the mattress enclosure chamber 28 defined by the distance between the mattress top and bottom 25 and 26 respectively. Thus, when inflated, the bladders resist compression of the mattress. The degree to which the bladders resist such compression, referred to here as firmness, is determined by the pressure to which the bladder is inflated. The use of a transducer e.g. 232*a* and 232*b*, as discussed above, is also illustrated. The positioning of the transducer within the bladder is not important as long as it is able to sense the pressure therein.

Figure 3:
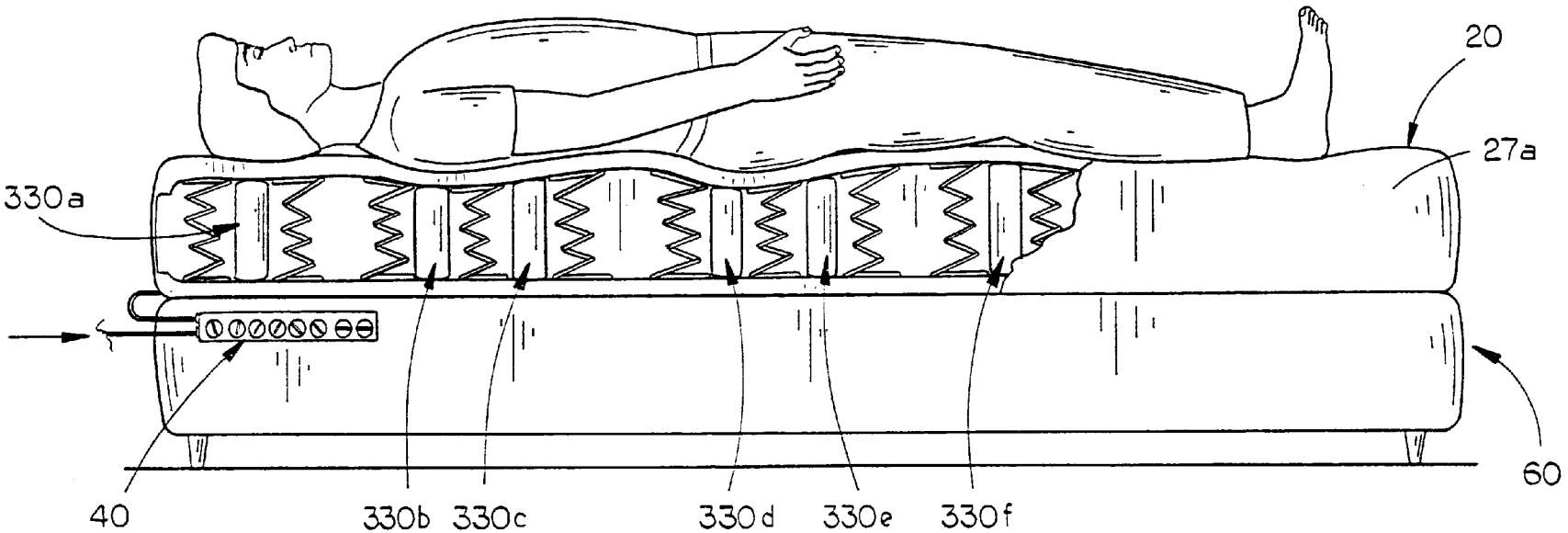
FIG. 3 is a sectional side view illustrating the use of the invention wherein the air bladders are inflated to different pressures in order to accommodate different loads.

FIG. 3 illustrates the mattress apparatus of the present invention in use. FIG. 3 is a part-sectional side view illustrating the positioning and orientation of the bladders within the mattress enclosure. As described above, the bladders are adapted to extend between the mattress top and bottom 25 and 26. The pressure to which the bladder is inflated resists its compression, thereby imparting a certain degree of firmness. As mentioned, this firmness may be adjusted by adjusting the pressure to which the bladder is inflated. FIG. 3 may also be used to illustrate the concept of zoning eluded to above.

As mentioned earlier, there are many ways in which to implement the concepts taught by the present invention. One method is to group a set of bladders in a "zone". A zone may be identified with a particular portion of the body. For example, referring to the figure, one zone may correspond to the head (bladder 330*a*), another to the upper torso (bladders 330*b* and *c*), another with the midsection (bladders 330*d* and *e*), and yet another with the legs (bladder 330*f*). The idea being that different firmnesses might be desirable for different parts of the body. Clearly many other groupings are possible. It is envisioned that the zoning would be accomplished by pneumatically linking the zoned bladders. This pneumatic linkage could be accomplished by connecting the zoned bladders to a single inflation air line or simply by setting the bladders in that zone to an equivalent pressure. Either way, the bladders in that zone would thus be inflated to the same pressure. Bladders in another zone would presumably be inflated to a pressure and firmness appropriate to that body portion.

As mentioned above, there are several methods of achieving individual firmness control with various degrees of precision and individuality. Another method is to separate the two sides of the mattress. The present invention suggests two ways of accomplishing this. First, two separate bladders 530*a* and 530*b* can be used end-to-end as shown in FIG. 5. Each of the two bladders 530*a* and 530*b* would be approximately one-half the width of the mattress. Thus, placing them end-to-end would traverse the mattress width. Since the bladders are separately inflatable, firmness may be independently set for each side of the mattress.

Figure 6:
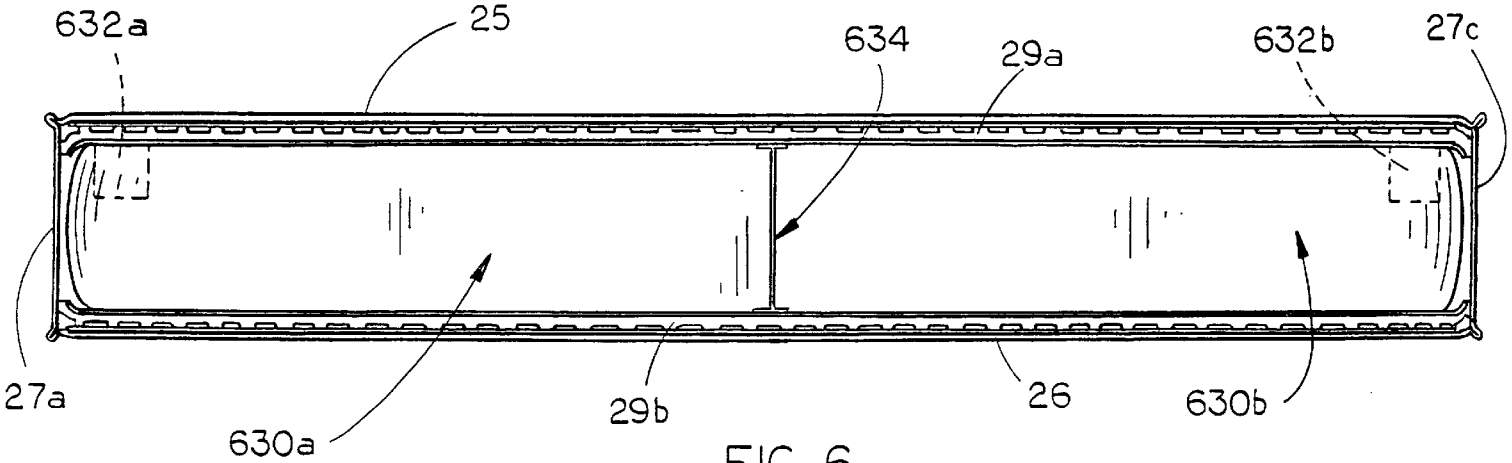
FIG. 6 is a view similar to that of FIG. 5 wherein two separate firmness control zones might be provided by dividing a single bladder into two separate pressure chambers using a single baffle.

Another method, illustrated in FIG. 6, would be simply to position a baffle 634 at approximately the center of bladder 630 thus forming left and right halves 630*a* and 630*b* respectively. As long as baffle 634 effects an airtight seal, bladder halves 630*a* and 630*b* may be separately inflated to different pressures if desired, again permitting the independent control of both sides of the mattress.

The bladders may be separately connected to inflation pump 50 through a control means 40 as described above. As also described, a computer 45 may be used to adjust the firmness of the mattress compensating for various factors such as individual need and even for the tossing and turning which may occur at night.

Figure 7:
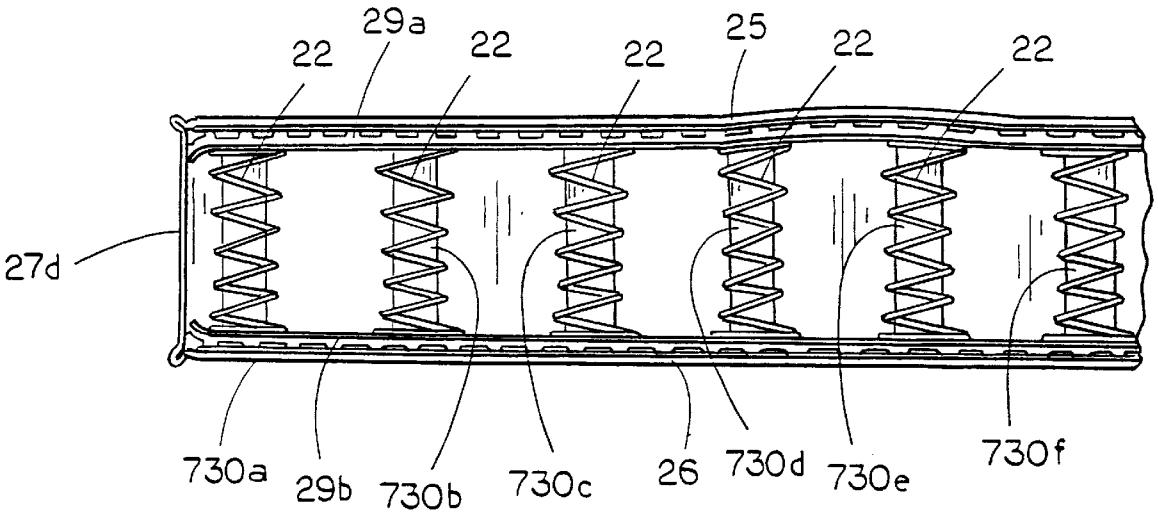
FIG. 7 is a side view showing yet another embodiment of the present invention wherein the plurality of bladders used for firmness control are positioned within each spring.

Perhaps the most precise regulation of firmness is provided by the embodiment illustrated in FIG. 7. In this embodiment, the plurality of bladders 730 are distributed within the mattress springs 22. For maximum control, each bladder 730 could be individually connected to the inflation source and individually controlled. Alternatively, several of the bladders could be pneumatically grouped or "zoned" together and inflated to the same pressure as described above.

It is apparent that numerous other modifications and variations of the present invention are possible in view of the above teachings. For example, there are endless combinations of grouping of bladders for zones. Additionally, there were discussed numerous possibilities for control and regulation of bladder inflation pressures.

Therefore, it is to be understood that the above description is in no way intended to limit the scope of protection of the claims and it is representative of only one of several possible embodiments of the present invention.

There has thus been shown and described an invention which accomplishes at least all the stated objectives.

I claim:

1. In combination:

an inflation device; and a spring mattress having a periphery and:

top and bottom walls and a side wall connecting said periphery thereof, said top, bottom and side walls defining an enclosed chamber having a width;

a plurality of vertically oriented springs arranged in horizontally spaced relation within said chamber;

a plurality of inflatable bladders disposed within said chamber and adapted for inflation to a given pressure in response to the introduction of a fluid therein, said bladder having a firmness proportional to the pressure of fluid contained therein;

means for connecting said plurality of bladders to said inflation device such that upon inflation, said bladders maintain said mattress top and bottom walls in spaced-apart relation, resisting downward pressure thereon in proportion to the pressure of fluid contained in said bladders; and means for controlling the fluid pressure within said bladders comprising a computer that separately controls the inflation of each bladder.

2. The inner spring mattress with firmness adjusting air bladders of claim 1 wherein each of said bladders spans the width of said mattress enclosed chamber and further comprises a baffle positioned within said bladder such that said bladder is subdivided widthwise defining two firmness zones, each of said firmness zones being independently inflatable by the inflation device.

3. The inner spring mattress with firmness adjusting air bladders of claim 1 wherein said plurality of bladders comprises a bladder disposed within each of said springs.

4. The inner spring mattress with firmness adjusting air bladders of claim 2 wherein a first number of said plurality of bladders is simultaneously connected to said inflation device, said first number of said plurality of bladders defining a first zone, at least a second number of said plurality of bladders is simultaneously connected to said inflation device, said second number of said plurality of bladders defining at least a second zone, and each of said zones is inflatable independent of each other.

5. The inner spring mattress with firmness adjusting air bladders of claim 1 wherein said means for adjusting the fluid pressure in said bladders is operative to adjust the firmness of the bladders as the sleeping individual rolls during the night.

6. The inner spring mattress with firmness adjusting air bladders of claim 1 wherein said means for controlling the fluid pressure in said bladders further comprises a transducer operative to monitor the pressure within a bladder and to regulate the inflation of said bladder in response thereto.

7. A method of adjusting the firmness of a mattress comprising the steps of:

providing an inflation device having a computer and a transducer;

providing a spring mattress having a periphery and:

top and bottom walls and a side wall connecting said periphery thereof, said top, bottom and side walls defining an enclosed chamber;

a plurality of vertically oriented springs arranged in horizontally spaced relation within said chamber;

a plurality of inflatable bladders disposed within said chamber and adapted for inflation to a given pressure in response to the introduction of a fluid therein, said bladder having a firmness proportional to the pressure of fluid contained therein; and means for connecting said plurality of bladders to said inflation device, such that upon inflation, said bladders contact and support said mattress top and bottom in proportion to the pressure of fluid contained in said bladders;

connecting said bladders to said inflation device; and inflating each of said bladders to a desired firmness, the computer and transducer separately controlling and adjusting the inflation of each bladder in response to the movement of an individual sleeping on the mattress.

8. The method of claim 7 wherein the step of providing the air inflatable bladders comprises the step of providing bladders having a baffle positioned within said bladder such that said bladder is subdivided widthwise defining two firmness zones, each of said firmness zones being independently inflatable by the inflation device, and wherein the step of inflating the bladders further comprises inflating the bladders such that the bladders are inflated to a desired pressure within each firmness zone.

9. The method of claim 7 wherein the step of providing a plurality of air inflatable bladders comprises the step of providing bladders wherein a first number of said plurality of bladders is simultaneously connected to said inflation device, said first number of said plurality of bladders defining a first zone, at least a second number of said plurality of bladders is connected to said inflation device, said at least a second number of said plurality of bladders defining at least a second zone, each of said zones being inflatable independently of each other, and wherein the step of inflating the bladders further comprises separately inflating each of said zones such that said zones are inflated to a desired pressure.

* * * * *